United States Patent [19]

Dreuilhe et al.

[11] Patent Number: 4,553,502

[45] Date of Patent: Nov. 19, 1985

[54] TUBE-TYPE HEAT EXCHANGER

[75] Inventors: Jacques Dreuilhe, L'Isle Adam; Paul-Victor Landet, Aulnay s/Bois, both of France

[73] Assignees: Framatome & Cie, Courbevoie; Charbonnages de France, Paris; Institut Francais du Petrole, Rueil Malmaison, all of France

[21] Appl. No.: 697,678

[22] Filed: Feb. 4, 1985

[30] Foreign Application Priority Data

Feb. 3, 1984 [FR] France ..... 84 01666

[51] Int. Cl.[4] ..... F22B 1/02

[52] U.S. Cl. ..... 122/4 D; 122/235 D; 122/235 K; 122/235 J; 122/249; 122/275; 122/511; 165/178; 165/104.16

[58] Field of Search ..... 122/235 D, 235 K, 235 J, 122/248, 249, 275, 278, 276, 511, 4 D; 165/175, 176, 178, 104.16

[56] References Cited

U.S. PATENT DOCUMENTS

| | | | |
|---|---|---|---|
| 1,083,199 | 12/1913 | Delaunay-Belleville | 122/235 D |
| 1,109,041 | 9/1914 | Cary | 122/235 D |
| 1,780,529 | 11/1930 | Lanterman | 122/249 |
| 3,672,847 | 6/1972 | Esselink | 122/275 X |
| 4,356,795 | 11/1982 | Loiez et al. | 122/511 |

FOREIGN PATENT DOCUMENTS

| | | | |
|---|---|---|---|
| 356328 | 9/1931 | United Kingdom | 122/249 |

*Primary Examiner*—Edward G. Favors

*Attorney, Agent, or Firm*—Pollock, Vande Sande & Priddy

[57] ABSTRACT

The exchanger is placed in a fluid of elevated temperature and comprises tubes connected to an inlet header and to an outlet header. The exchanger comprises a plurality of panels (4) constituted by tubes (41 to 48) extending below two inlet headers and two outlet headers, to which they are connected at the upstream and downstream ends, and forming two semi-panels which are imbricated one inside the other, each semi-panel comprising a subheader tube (41 or 42) connected to an inlet header (21 or 22) and being divided into at least one tube (43,44,45 or 46, 47, 48) which is coiled into a laced configuration so that the two sub-header tubes (41 or 42) extend vertically within the envelope of said tubes having a laced configuration and they support them through cantilever supports (411, 421). This exchanger may be in particular employed in a fluidized bed apparatus or for the recovery of the heat of gas or fumes.

8 Claims, 6 Drawing Figures

TUBE-TYPE HEAT EXCHANGER

The present invention relates to a tube-type heat exchanger placed in a fluid at elevated temperature and comprising tubes connected to an inlet header and to an outlet header.

A heat recuperation boiler is known from the patent FR-A-No. 2 449 845 which comprises a plurality of exchange elements formed by tubes wound in a vertical coil configuration. This design presents problems in particular as concerns the support assembly.

The present invention, as characterized in the claims, has for object to solve the problems of expansion and supporting for a bundle of tubes of the aforementioned type placed in a fluid at a very elevated temperature, in particular in a stream of hot gas or hot smoke or in the fluidized bed of a combustion apparatus. The design adopted enables the pitch between the coils formed by the tubes to be maintained and avoids the twisting and vibrations of these tubes. This design moreover limits the clogging phenomenon when the smoke is charged with dust.

The exchanger according to the invention is characterized by the fact that it comprises a plurality of panels constituted by tubes extending below two inlet headers and two outlet headers to which they are connected at the upstream and downstream ends and forming two semi-panels imbricated one inside the other, each semi-panel comprising a sub-header tube connected to an inlet header and to which is connected at least one tube having a laced configuration so that the two sub-header tubes extend vertically within the envelope of said laced tubes and they support them by means of cantilever supports.

According to a feature, each loop of a tube having a laced or U-configuration bears against two supports fixed to the two sub-header tubes.

According to another feature, the inlet and outlet headers extend horizontally and the two outlet headers are located at the same height relative to each other and above the two inlet headers which are located at the same height relative to each other.

According to a further feature, the tubes having a laced configuration extending from a sub-header tube are wound between the loops of the laced tubes extending from the second sub-header tube, the direction of winding being the same.

The invention will now be described in more detail with reference to the embodiment which is given by way of example and represented by the accompanying drawings, in which.

Figure 1:
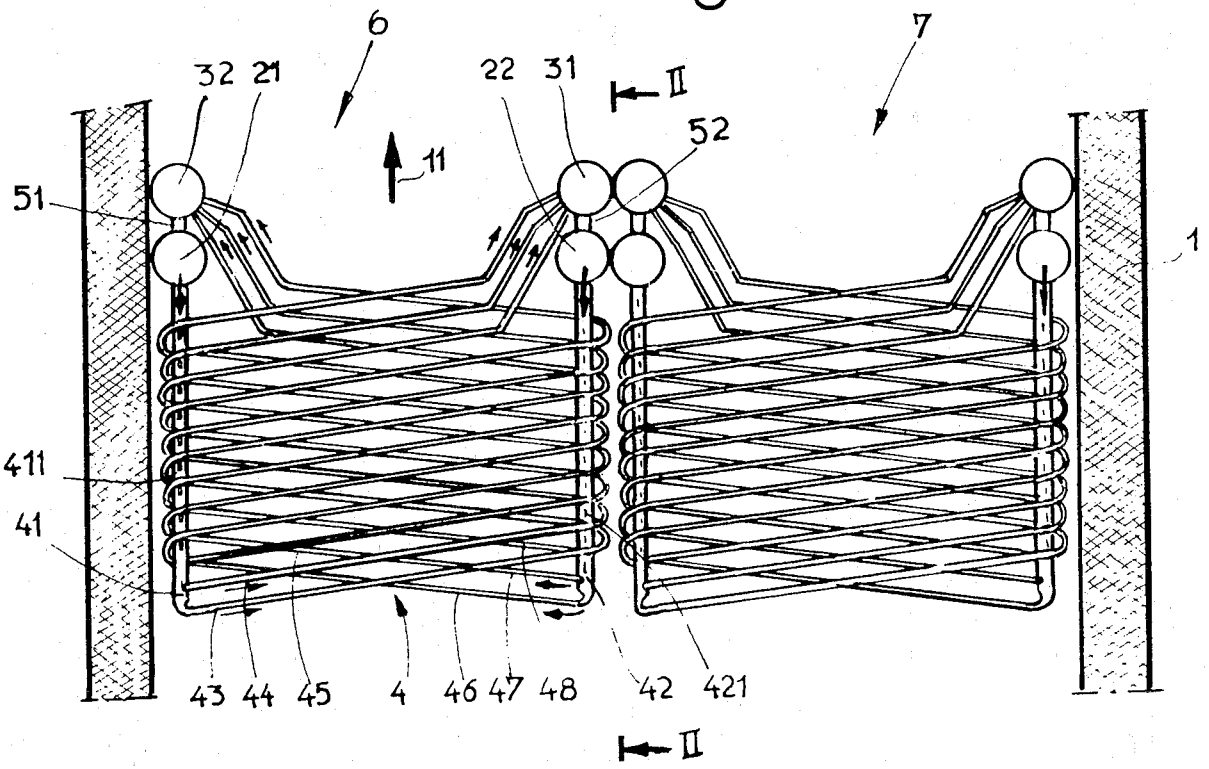
FIG. 1 is an elevational view of the exchanger.
Figure 2:
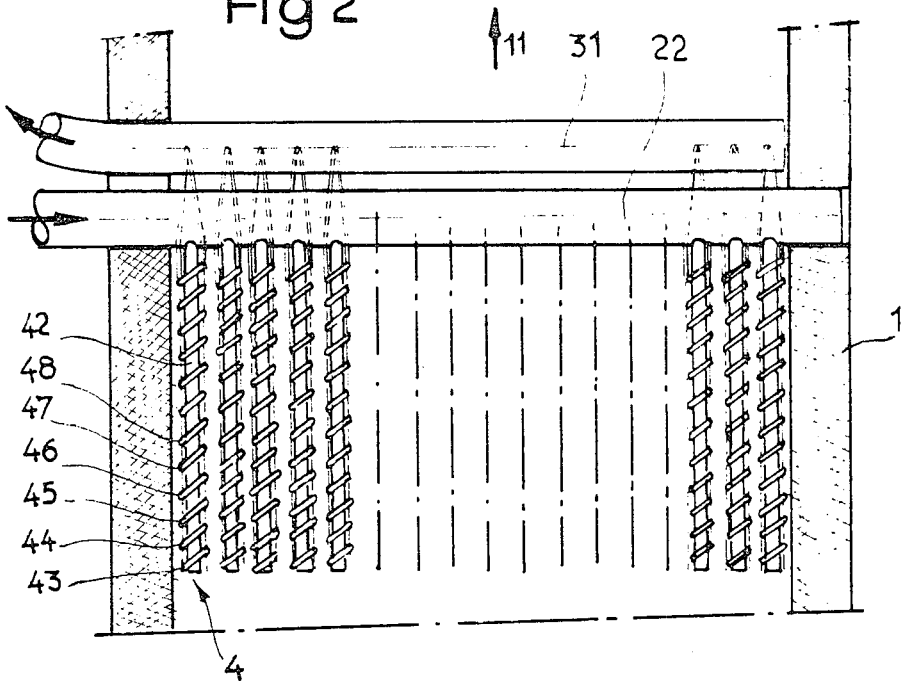
FIG. 2 is a sectional view taken on line 2—2 of FIG. 1, showing the exchanger in side elevation.
Figure 3:
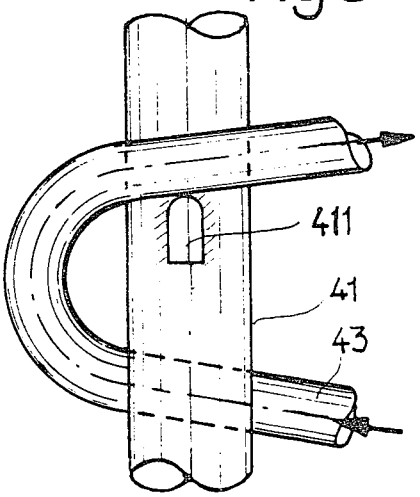
FIG. 3 is a view of a detail of FIG. 1.
Figure 4:
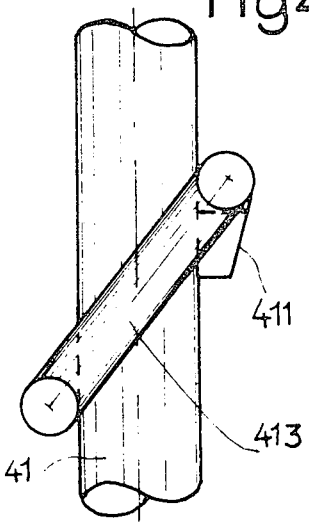
FIG. 4 is a view of a detail of FIG. 2.

The exchanger represented in particular in FIGS. 1 and 2 is placed in a fluid of elevated temperature and in particular in a solid-gas mixture of the fluidized bed of a fluidized bed apparatus, or in a current of hot gas or hot fumes coming for example from a furnace or a combustion chamber of a gas turbine. The fluid (solid-gas mixture, gas or fumes) is contained in a vessel 1 or conducted in a heat-insulated flue 1. The current of gas or fumes flows vertically upwardly in the direction of arrow 11.

The illustrated embodiment comprises two bundles of tubes carrying the reference numerals 6 and 7 respectively.

Each bundle comprises a pair of inlet headers 21, 22 which receive a relatively cool gas and a pair of outlet headers 31, 32 which receive the hot gas after the vapour has passed through the tubes 41 to 48.

The headers 21, 22, 31, 32 extend through a wall of the vessel or of the flue horizontally substantially to the opposite wall. The inlet headers 21 and 22 are substantially located at the same height relative to each other. Likewise, the outlet headers 31 and 32 are substantially located at the same height relative to each other. The outlet headers 31 and 32 are located above the inlet headers 21 and 22 (i.e. on the downstream side relative to the direction of flow 11 of the hot gas). The distance between the outlet headers 31 and 32 is substantially equal to the distance between the inlet headers 21 and 22.

The inlet headers 21 and 22 are supported at their ends by the vessel or the flue 1. They support, through spacer members 51 and 52, the outlet headers 32 and 31 respectively, the whole of the bundle being suspended. The inlet headers 21 and 22 for the cool gas constitute the support framework of the bundles.

Each bundle comprises a plurality of panels 4 of tubes which extend vertically in adjacent relation to each other and are formed by tubes 41 to 48 extending below two inlet headers 21 and 22 and two outlet headers 31 and 32. These tubes are connected at the upstream end to the pair of inlet headers 21 and 22 and at the downstream end to the pair of outlet headers 31 and 32. Each panel 4 comprises two semi-panels which are imbricated one inside the other and each connected to an inlet header 21 or 22 and to an outlet header 31 or 32.

Each semi-panel comprises a sub-header inlet tube 41 or 42 which is connected under the inlet header 21 or 22 respectively and which is divided into tubes bent into a U- or laced configuration 43, 44, 45 or 46, 47, 48 respectively, these laced tubes being connected to the outlet header 31 or 32 which is associated with the inlet header. An outlet header such as 31 associated with an inlet header such as 21 in a semi-panel is located above the inlet header 22 of the other semi-panel. The laced tubes 43 to 45 or 46 to 48 are connected to the lower part of a sub-header tube 41 or 42 which extends vertically below the inlet header to which it is connected. The laced tubes 43 to 48 are bent in such manner that their axes form "flattened coils" centered on an axis constituting the vertical axis of symmetry of the two sub-header tubes 41 and 42. These two sub-header tubes 41 and 42 are located within the imaginary cylinder enveloping the laced tubes 43 to 48 which surround therefore said sub-header tubes. The laced tubes such as 43 to 45 leading from a sub-header tube 41 are coiled in the gap between the coils of the laced tubes 46 to 48 leading from the second sub-header tube 42 so that these tubes are imbricated one inside the other, the direction of coiling of the tubes 43 to 45 being the same as that of the tubes 46 to 48. These laced tubes 43 to 48 are coiled in such manner as to have rectilinear portions connected by elbows or loops. They form on each side of the sub-header tubes 41 and 42 a series of rectilinear sections. They are coiled with such pitch that there is a gap between each tube and the neighbouring tube. Each laced tube 43 to 48 is, in a loop, in contact with two opposed generatrices of a sub-header tube. In each loop, the intrados of the tube is separated from the neighbouring sub-header tube so as to permit expansions.

Each sub-header tube 41 or 42 has, along a generatrix, a series of cantilever supports 411 and 421 respectively. These cantilever supports are fixed at equal distances apart along a generatrix of each sub-header tube. The laced tubes 43 to 48 bear against these cantilever supports 411 and 421. Each coil of a laced tube is supported by two supports 411 and 421 fixed to the two sub-header tubes. The supports 411 and 421 are disposed in each of the gaps between two laced tubes. The supports are made from metal and are welded to the sub-header tubes. By way of a modification, these supports could be formed by ceramic rings surrounding the sub-header tubes.

The exchanger operates in the following manner:

The vessel or the flue 1 contains or conducts a very hot fluid (solid gas mixture of a fluidized bed or gas or fumes).

The exchanger is used for re-heating a relatively cool gas which is fed to the inlet headers 21 and 22.

The cool gas to be re-heated descends in the sub-header tubes 41 and 42 and then circulates in the laced tubes 43 to 48 before being received in the outlet headers 31 and 32. During this passage, the gas circulating in the tubes recovers the heat of the fluidized bed or of the hot gas outside the tubes.

Figure 5:
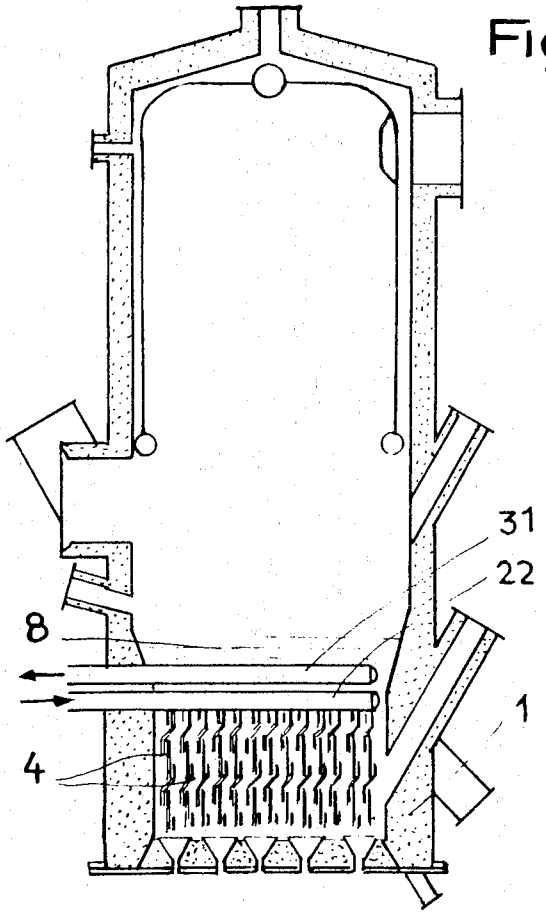
FIG. 5 show the application of the exchanger according to the invention in a fluidized bed apparatus.

In the application shown in FIG. 5, the exchanger is placed within a bed 8 of a fluidized bed boiler. This exchanger constitutes an air heater and it is placed upstream of the steam producing bundle. For example, the air which enters the exchanger comes from a compressor and the hot air issuing therefrom is conducted to a gas turbine.

Figure 6:
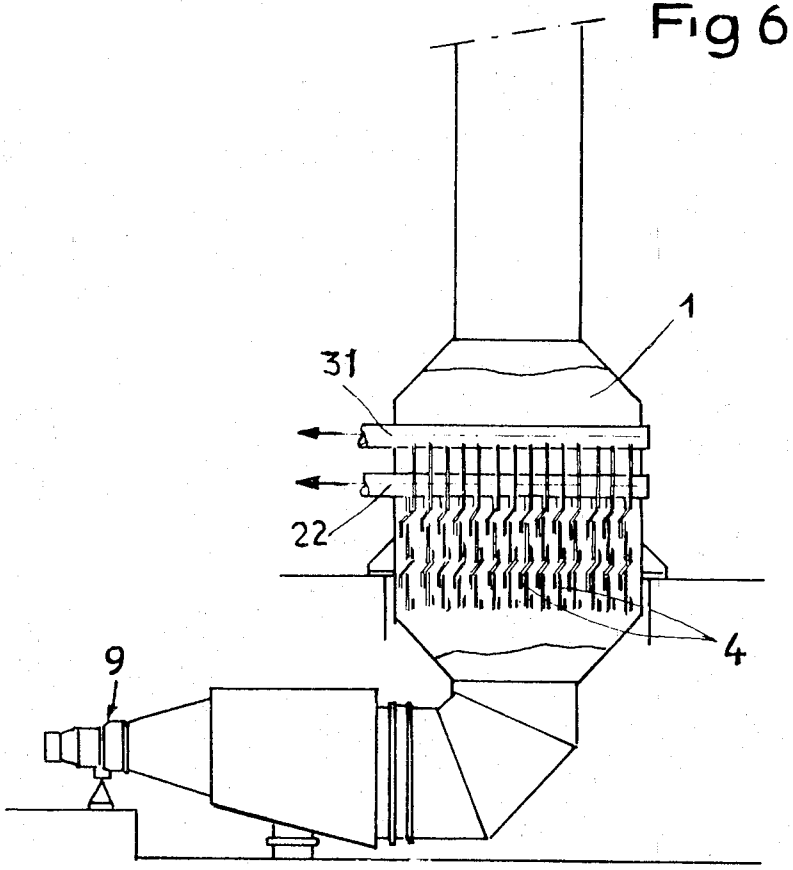
FIG. 6 shows the application of the exchanger according to the invention in the recovery of heat from combustion fumes.

In the application shown in FIG. 6, the exchanger is placed in a conduit or flue 1 which conducts the fumes at very high temperature coming from a gas turbine 9. The air which enters the exchanger comes from the compressor of the turbine and the hot air issuing therefrom is conducted to the combustion chamber of the turbine.

It will be understood that it is possible, without departing from the scope of the invention defined in the claims, to imagine modifications and improvements in detail and to envisage the use of equivalent means.

What is claimed is:

1. A tube-type heat exchanger placed in a fluid at elevated temperature and comprising two inlet headers, two outlet headers, a plurality of panels of tubes extending below said two inlet headers and said two outlet headers, to which headers the tubes are connected at upstream and downstream ends of the tubes and form two semi-panels which are imbricated one inside the other, each semi-panel comprising a sub-header tube which is connected to an inlet header and divided into at least one tube having a laced configuration so that the two sub-header tubes pertaining to the two semi-panels extend vertically inside an envelope of said laced tubes and support said laced tubes by means of cantilever supports.

2. An exchanger according to claim 1, wherein each tube having a laced configuration has a loop portion which bears against two of said supports which are fixed to the sub-header tubes.

3. An exchanger according to claim 1, wherein the two inlet headers extend horizontally and the two outlet headers are located at the same height relative to each other above the two inlet headers, which inlet headers are located at the same height relative to each other.

4. An exchanger according to claim 1, wherein the inlet headers are supported at ends thereof by a vessel containing said fluid at elevated temperature and the inlet headers support the outlet headers through spacer members.

5. An exchanger according to claim 1, wherein the inlet headers are supported at ends thereof by a flue containing said fluid at elevated temperature and the inlet headers support the outlet headers through spacer members.

6. An exchanger according to claim 1, wherein the tubes having a laced configuration extending from one sub-header tube are coiled between coils of the tubes having a laced configuration which extend from the other sub-header tube, the directions of coiling being the same.

7. An exchanger according to claim 1, employed for re-heating a gas conducted to the inlet headers.

8. A tube-type heat exchanger placed in a fluid at elevated temperature and comprising two inlet headers, two outlet headers, a plurality of panels of tubes extending below said two inlet headers and said two outlet headers, to which headers the tubes are connected at upstream and downstream ends of the tubes and form two semi-panels which are imbricated one inside the other, each semi-panel comprising a sub-header tube which is connected to an inlet header and divided into at least one tube having a laced configuration so that the two sub-header tubes pertaining to the two semi-panels extend vertically inside an envelope of said laced tubes and support said laced tubes by means of cantilever supports, said heat exchanger being combined with a fluidized bed apparatus and placed within a fluidized bed of said apparatus.

* * * * *